US006264026B1

(12) United States Patent
Bradley

(10) Patent No.: US 6,264,026 B1
(45) Date of Patent: Jul. 24, 2001

(54) FOOD, BEVERAGE AND UTILITY TRAY

(76) Inventor: Vincent H. Bradley, 11715 Pine Forest, Dallas, TX (US) 75230

( * ) Notice: Subject to any disclaimer, the term of this patent is extended or adjusted under 35 U.S.C. 154(b) by 0 days.

(21) Appl. No.: 09/433,834

(22) Filed: Nov. 3, 1999

Related U.S. Application Data

(63) Continuation-in-part of application No. 08/839,721, filed on Apr. 15, 1997, now Pat. No. 5,971,139.

(51) Int. Cl.[7] ..... B65D 77/00

(52) U.S. Cl. ..... 206/217; 206/564; 206/509

(58) Field of Search ..... 206/217, 541, 206/561, 564, 509–511, 549; 229/904; D7/507, 543, 552.1, 552.2, 553.1, 553.5, 305, 602

(56) References Cited

U.S. PATENT DOCUMENTS

| | | | | |
|---|---|---|---|---|
| D. 256,201 | | 8/1980 | Ventura . | |
| D. 280,669 | * | 9/1985 | Hammeke | 206/561 |
| D. 291,957 | | 9/1987 | Stevens . | |
| D. 297,799 | | 9/1988 | Hammer . | |
| D. 316,800 | * | 5/1991 | Wertheim | D7/507 |
| D. 317,102 | | 5/1991 | Clark . | |
| D. 326,588 | | 6/1992 | Meisel . | |
| D. 331,860 | | 12/1992 | Stanfield . | |
| D. 338,374 | | 8/1993 | Jacobson . | |
| D. 351,085 | | 10/1994 | Schmidt . | |
| D. 352,205 | | 11/1994 | Swetharanyam . | |
| D. 353,742 | * | 12/1994 | Lewis et al. | D7/553 |
| D. 354,201 | | 1/1995 | Van de Gaaf . | |
| D. 356,471 | | 3/1995 | Corsi . | |
| D. 376,297 | * | 12/1996 | Jacobson | D7/613 |
| D. 376,928 | * | 12/1996 | Lorenzana et al. | D7/500 |
| D. 378,477 | * | 3/1997 | Sussman | D7/500 |
| 3,498,470 | | 3/1970 | Thomas . | |
| 3,504,832 | | 4/1970 | Corvetti . | |
| 3,905,506 | * | 9/1975 | Florian | 206/561 |
| 4,208,006 | * | 6/1980 | Bixler et al. | 206/564 |
| 4,732,274 | | 3/1988 | Bouton . | |
| 4,744,597 | | 5/1988 | Bauman . | |
| 4,852,738 | * | 8/1989 | Craig et al. | 206/63.5 |
| 4,989,742 | | 2/1991 | Powell . | |
| 5,259,528 | | 11/1993 | Pace . | |
| 5,335,787 | | 8/1994 | Finchum . | |
| 5,346,070 | | 9/1994 | McSpadden . | |
| 5,381,901 | * | 1/1995 | Hundley | 206/457 |
| 5,421,459 | | 6/1995 | Mazzotti . | |
| 5,449,071 | * | 9/1995 | Levy | 206/569 |
| 5,887,749 | * | 3/1999 | Schommer et al. | 220/575 |

* cited by examiner

*Primary Examiner*—Shian Luong
(74) *Attorney, Agent, or Firm*—John M Harrison

(57) ABSTRACT

A food, beverage and utility tray which includes in a first embodiment a plate section having downwardly-extending legs or supports and a flat area bordered by a tapered lip for receiving and supporting a plate. An intermediate section extends from the plate section and includes a downwardly-extending conical hand grip and a slotted cup holder. A stiffening and finger access indentation typically extends from the plate section, through the upper surface of the hand grip to the cup holder. A downwardly-extending arm rest may be provided in the plate section for engaging the forearm of the user. In another embodiment a supplemental cup holder may be included in the intermediate section between the plate section and the cup holder. In yet another embodiment two to four legs may be provided on the plate section and these legs may project from the lip extending around the plate section as substantially flat or slightly curved supports, or as frusto-conical legs extending from the plate section. In still another embodiment a recess or indentation is provided in the plate section for accommodating a saucer, salad or dessert plate and a pair of curved stiffeners are provided in the intermediate section for strengthening the tray.

24 Claims, 5 Drawing Sheets

FOOD, BEVERAGE AND UTILITY TRAY

CROSS-REFERENCE TO RELATED APPLICATIONS

This application is a contituation-in-part of my U.S. patent application Ser. No. 08/839,721 filed Apr. 15, 1997, now U.S. Pat. No. 5,971,139.

BACKGROUND OF THE INVENTION

1. Field of the Invention

This invention relates to food trays and more particularly, to food, beverage and utility trays typically for holding a food plate, utensils and at least one beverage container, as well as other items such as art supplies, in one hand. One of the problems which exists at parties and other social gatherings where food is served in buffet style is that of balancing a plate and beverage container while standing, drinking and eating. This problem is intensified under circumstances where the plates are relatively small and are therefore not designed for accommodating a drink holder such as a glass or cup, in addition to food. This circumstance places the user in a dilemma as to how to eat the food and drink the beverage, while at the same time balancing the plate and cup in one hand or on a usually undersized plate.

The food, beverage and utility tray of this invention solves the problem of balancing the plate or cup or glass while standing, eating and drinking. The tray also serves as a one-handed pallet for art supplies and the like. The food, beverage and utility tray is characterized by a plate section designed to accommodate plates and saucers, as well as salad and dessert plates of various size, construction and shape. In one embodiment, the plate section has a circular inner plate section of sufficient size to accommodate an average size dinner plate or paper plate and an indentation within the perimeter of the inner plate section for accommodating a smaller plate such as a saucer, salad plate and dessert plate. The plate section is bordered by a raised lip to prevent inadvertent sliding of the plate or saucer from the inner plate section or the recessed area, and an intermediate section joins the plate section and includes a typically serrated hand grip which can double as a utensil receptacle and a napkin holder. An arm rest may also extend downwardly from the plate section to rest on the forearm of the user as the user grasps the hand grip in one hand, leaving the other hand free for eating and drinking.

In other embodiments, the food, beverage and utility tray may he characterized by a pair of slotted or unslotted beverage container (cup) holders and typically two to four, substantially flat or slightly curved and inwardly-extending legs or supports extending from the lip of the plate section, or two to four frusto-conical legs or supports projecting from the plate section itself the legs or supports of which are typically equal in length to the length of the hand grip and the cup holder, for stabilizing the tray on a flat surface. Additionally, the lip projecting around the plate section, as well as around the intermediate section and the hand grip and cup holder or holders of the trays are tapered, such that multiple trays can be stacked in a nested configuration.

In the dual beverage container or cup holder embodiment of the invention, the cup holder is typically located in a concave expanse of one side of the intermediate section, and may be slotted to accommodate a second cup, glass or beverage container, including a wine glass, goblet or other stem, in a single tray.

2. Description of the Prior Art

Many food trays have been designed over the years to hold both a food plate and a beverage container, in an effort to free one hand of the user for eating and drinking. Many of these designs facilitate holding the food tray in one hand, but are awkward and difficult to hold and manage without spilling the food or beverage. Furthermore, many of the designs cannot be nested or stacked for efficient storage. Among the designs for various food and utility trays are those detailed in the following patents: Design Pat. No. 256,201, dated Aug. 5, 1980, to Edward Ventura, entitled "Chair and Arm Tray"; Design Pat. No. 291,957, issued Sept. 22, 1987, to Kenneth D. Stevens, entitled "Combined Canape Tray and Glass Holder"; Design Pat. No. 297,799, issued Sept. 27, 1988, to Linda S. Hammer, entitled "Combination Drinking Cup and Snack Receptacle"; Design Pat. No. 317,102, dated May 28, 1991, to I. M. Clark, et al, entitled "Food Carrying Tray"; Design Pat. No. 326,588, dated Jun. 2, 1992, to Irving S. Meisel, entitled "Serving Tray"; Design Pat. No. 331,860, dated Dec. 22, 1992, to John Stanfield, entitled "Combined Plate and Beverage Holder"; Design Pat. No. 338,374, issued Aug. 17, 1993, to L. N. Jacobson, entitled "Food and Beverage Tray"; Design Pat. No. 351,085, dated Oct. 4, 1994, to George Schmidt, entitled "Stacking Plastic Buffet Wear"; Design Pat. No. 352,205, dated Nov. 8, 1994, to S. W. Etharanyan, entitled "Food Supporting Tray"; Design Pat. No. 354,201, dated Jan. 10, 1995, to Vandegraf, Jr., entitled "Party Plate"; Design Pat. No. 356,471, dated Mar. 21, 1995, to R. A. Corsi, entitled "Compartmented Food Tray For A Ball Stadium"; U.S. Pat. No. 3,498,470, dated Mar. 3, 1970, to D. J. Thomas, entitled "Serving Tray With Integral Cup Holder"; U.S. Pat. No. 3,504,882, dated Apr. 7, 1970, to Pete Corvetti, entitled "Food and Drink Serving Tray"; U.S. Pat. No. 4,732,274, dated Mar. 22, 1988, to J. A. Bouton, entitled "Portable Tray Table"; U.S. Pat. No. 4,744,597, dated May 17, 1988, to Charles E. Bauman, et al, entitled "Food and Beverage Tray"; U.S. Pat. No. 4,989,742, dated Feb. 5, 1991, to Earl A. Powell, entitled "Tray Apparatus"; U.S. Pat. No. 5,259,528, dated Nov. 9, 1993, to Michael A. Pace, et al, entitled "Combination Food, Drink, Utensil and Napkin Tray"; U.S. Pat. No. 5,335,787, dated Aug. 9, 1994, to John A. Finchum, et al, entitled "Food and Beverage Tray"; U.S. Pat. No. 5,346,070, dated Sept. 13, 1994, to D. S. McSpadden, entitled "Portable Food Tray With Cup Holder"; U.S. Pat. No. 5,421,459, dated Jun. 6, 1995, to M. Mazzotti, entitled "Multicompartment Tray".

It is an object of this invention to provide a utility tray for carrying a food plate and beverage, which tray is easy to hold and manipulate with one hand while supported on the forearm, when eating and drinking with the other hand.

Another object of this invention is to provide a tray which can be held in one hand with a handle or grip which is distinct from and more comfortable to hold than the cup holder element of the tray.

Yet another object of the invention is to provide a food, beverage and utility tray which is characterized by lightness of weight, nesting capability for easy storage and is easily supportable in one hand to facilitate eating and drinking from plates and glasses, including stems, and cups fitted into recessed areas and compartments provided in the tray or to utilize as a pallet while painting.

Still another object of this invention is to provide a food, beverage and utility tray which is characterized by a plate section fitted with two or more legs or supports and an upward-standing border or lip, and is configured to accommodate plates of various type and size; an intermediate section extending from the plate section and provided with at least one, typically cone-shaped, slotted glass or cup holder; and a hollow, cone-shaped, preferably serrated and hollow hand grip, which hand grip can also serve as a napkin and utensil repository.

A still further object of this invention is to provide a new and improved, kidney-shaped food, beverage and utility tray which can be typically constructed of a vacuum moldable or injection-moldable material such as a suitable plastic and is designed with a tapered plate section having downwardly-extending legs, a curved intermediate section, one or more, typically frusto-conical glass or cup holders which may be slotted to accommodate stems and further includes a frusto-conical hand grip, to facilitate nesting and stacking of multiple trays in an optimum storage configuration.

Still another object of this invention is to provide a new and improved food, beverage and utility tray which is characterized by a plate section having a raised, tapered lip or rim extending around the periphery thereof and having nesting "standoffs"; or stops, as well as a central recessed area for receiving small plates such as salad plates and dessert plates. Further included is a downwardly-extending arm rest for resting the tray on the forearm of a user when the user grasps a hand grip extending from an intermediate section lying adjacent to the plate section. One or two glass or cup holders with finger access recesses and typically having slots to accommodate stems, are provided in the intermediate section, along with tray stiffeners, for receiving one or more beverage containers, as desired.

SUMMARY OF THE INVENTION

These and other objects of the invention are provided in a new and improved food, beverage and utility tray which affords optimum ergonomic comfort for a user, and is characterized in a first preferred embodiment by a plate section of sufficient size and shape to accommodate an ordinary dinner plate or paper plate or a paint receptacle for art supplies. The plate section is fitted with an upward-standing, tapered lip around the periphery thereof and an intermediate section extending from the plate section and accommodating a downwardly-extending, frusto-conical hand grip and one or more slotted or unslotted cup holders. In a first preferred embodiment at least two, and typically four, spaced-apart, flat or slightly curved plate legs project from the raised lip encircling the plate section and are typically equal in length with the hand grip and the cup holder or holders, to facilitate resting the tray on a flat surface in level configuration. In another embodiment an arm rest extends downwardly from the plate section for resting on the forearm of a user when the user grips the hand grip, for steadying and supporting the tray in functional configuration while the user is standing or sitting. In still another embodiment two or more, spaced-apart, frusto-conical legs extend downwardly from the plate section and are planar with the hand grip and the cup holder or holders at the bottoms thereof, for supporting the cup on a flat surface in level configuration. And in yet another preferred embodiment of the invention a recess or indentation is provided in the plate section to accommodate a smaller dessert or salad plate.

BRIEF DESCRIPTION OF THE DRAWINGS

The invention will be better understood by reference to the accompanying drawings, wherein:

FIG. 7 is a perspective view of yet another embodiment of the food, beverage and utility tray illustrated in FIGS. 1 and 2, more particularly illustrating a plate indentation or recession in the plate section for accommodating a smaller plate such as a saucer, salad plate, dessert plate and the like.

DESCRIPTION OF THE PREFERRED EMBODIMENTS

Figure 1:
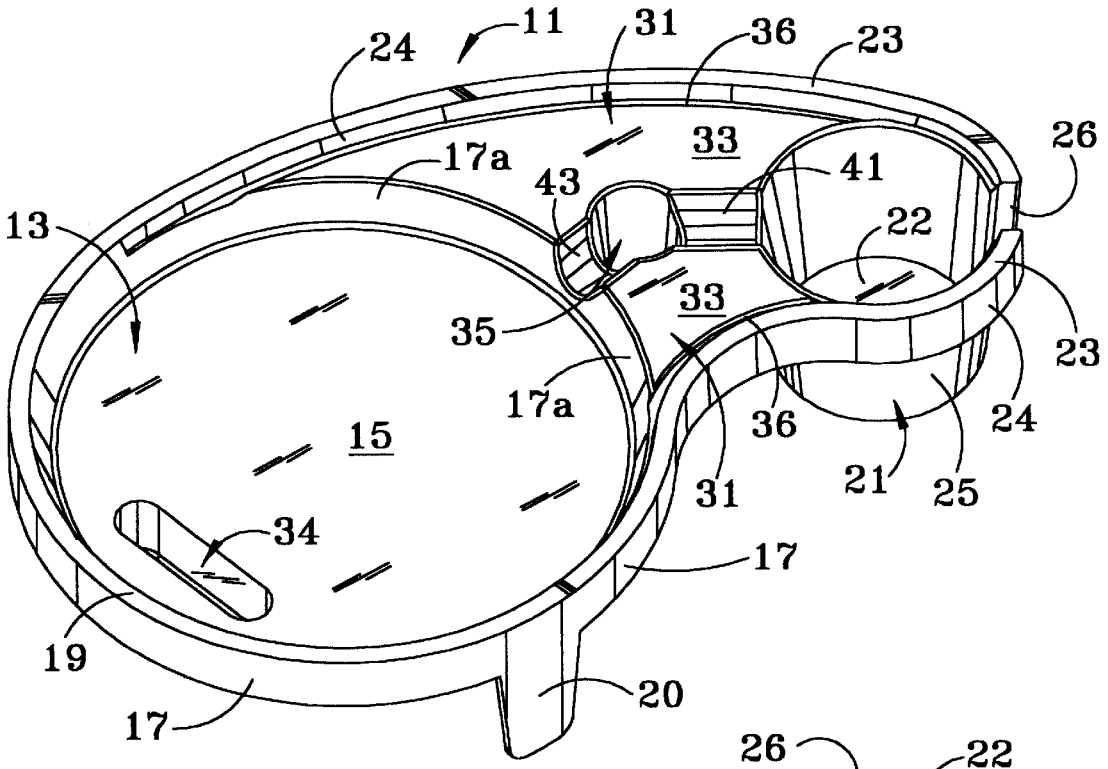
FIG. 1 is a perspective view of a first preferred embodiment of the food, beverage and utility tray of this invention, illustrating a single, slotted glass or cup holder, a plate section, an intermediate section joining the plate section, a hand grip and an optional arm rest extending from the intermediate section and the plate section, respectively, with a pair of substantially flat, oppositely-disposed legs or supports extending downwardly from the plate section.
Figure 2:
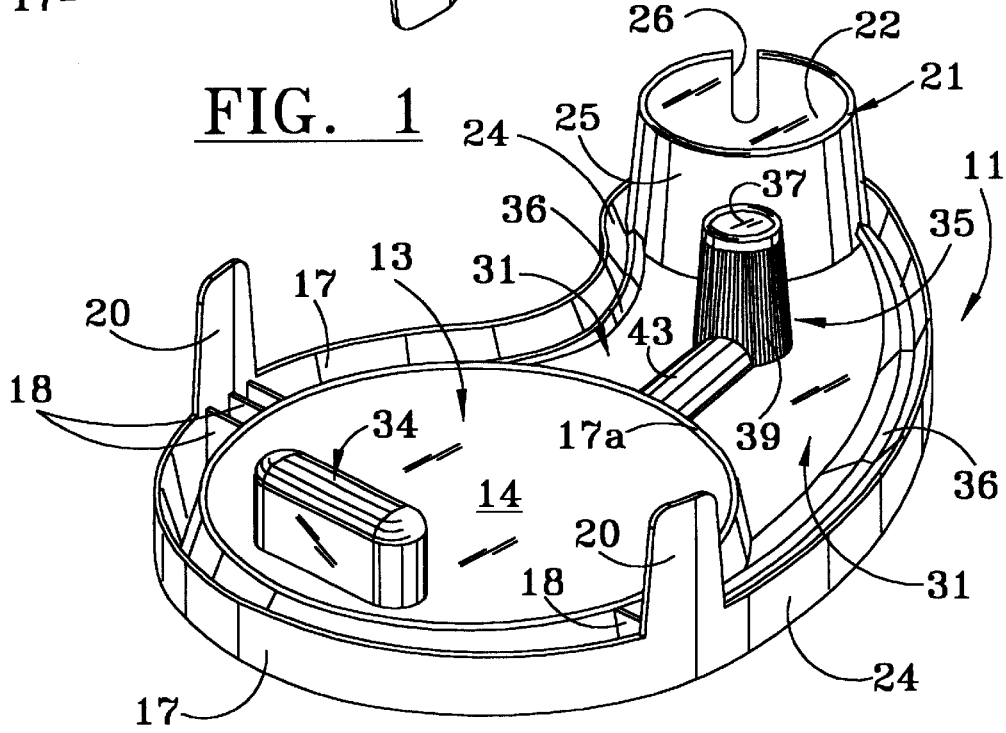
FIG. 2 is an inverted perspective view of the food, beverage and utility tray illustrated in FIG. 1.

Referring initially to FIGS. 1 and 2 of the drawings, a first preferred embodiment of the food, beverage and utility tray of this invention is generally illustrated by reference numeral 11. The food, beverage and utility tray 11 is characterized by a rounded plate section 13, having a circular planar inner section 15 of sufficient size, typically about ten inches in diameter, to accommodate a plate, including a paper plate or dinner plate of average size. A raised, tapered lip 17 extends around the circumference of the inner section 15 of the plate section 13 and joins a lip extension 17*a*, to retain a plate or an art supply tray (not illustrated) on the plate section 13, under circumstances where the food, beverage and utility tray 11 might be tipped or bumped. The plate section bottom 14 of the inner plate section 15 is typically substantially flat like the inner plate section 15, as illustrated. The upper or top surface 19 of the raised lip 17 and the lip extension 17*a* is typically planar and parallel to the planar inner section 15, although it may be rounded, as desired. The raised lip 17 and lip extension 17*a* are tapered downwardly and inwardly from the upper surface 19 to the inner section 15, to stiffen the food, beverage and utility tray 11 and facilitate stacking of multiple trays in nesting configuration when the trays are not in use. Holes or other openings (not illustrated) may be located in the plate section 13 for draining of liquids from the plate section 13, as deemed necessary.

As further illustrated in FIG. 2 of the drawings, three lip stiffeners 18 are provided between the plate section 13 and the tapered raised lip 17 to serve as "standoffs"; or stops and facilitate nesting of multiple trays, as well as stiffening of a pair of lip supports 20, extending from the raised lip 17 across the plate section bottom 14. The lip supports 20 have a very slight curvature from side-to-side, but are substantially flat and designed to support the plate section 13 on a flat table or other surface, as hereinafter further described. As further illustrated in FIGS. 1 and 2, in a preferred embodiment an arm rest 34 extends through the plate section 13, downwardly substantially parallel to the slightly outwardly-extending lip supports 20 for resting on the forearm (not illustrated) of a user when the food, beverage and utility tray 11 is in functional configuration.

Furthermore, an intermediate section 31 extends from the plate section 13, typically in an esthetically-pleasing curve to define a substantially kidney-shaped tray, and terminates at a cup holder 21, which is downwardly-extending through the plane of the upper surface 33 of the intermediate section 31, as illustrated. A flat or rounded upper surface 23 is shaped in an intermediate lip 24, which extends the raised lip 17 of the plate section 13. The cup holder bottom 22 of the cup holder 21 is preferably substantially co-extensive with the extending ends or bottoms of the lip supports 20, to facilitate level placement of the food, beverage and utility tray 11 on a flat surface. Furthermore, a stem slot 26 is preferably provided in the normally frusto-conical side 25 and the cup holder bottom 22 of the cup holder 21, to accommodate a wine glass, goblet or other "stem" (not illustrated) in the cup holder 21. A hand grip 35 having serrations 39, projects through the upper surface 33 of the intermediate section 31, between the cup holder 21 and the plate section 13 and terminates in a hand grip bottom 37, that is also coextensive with the cup holder bottom 22 and the extending ends or edges of the spaced-apart lip supports 20. Accordingly, in a preferred embodiment of the invention the typically slotted cup holder bottom 22 of the cup holder 21, the hand grip bottom 37 of the hand grip 35 and the bottom, supporting edges of the two lip supports 20, lie in a common plane to facilitate steady, substantially horizontal support of the food, beverage and utility tray on a table or other flat surface (not illustrated).

In another preferred embodiment the invention illustrated in FIGS. 1 and 2, a first indentation 41 extends into and through the upper surface 33 of the intermediate section 31 from the cup holder 21 to the hand grip 35 and a second indentation 43 extends through the upper surface 33 of the intermediate section 31 from the hand grip 35 to the plate section 13. The first indentation 41 and second indentation 43 are designed to stiffen the upper surface 33 of the intermediate section 31 to aid in the structural integrity of the food, beverage and utility tray 11. The first indentation 41 also serves as an access slot, as does the stem glass slot 26 in the intermediate lip 24, to access a short cup or glass seated in the cup holder 21. The second indentation 43 also serves as a finger access to remove a plate (not illustrated) from the plate section 13. A pair of curved stiffeners 36 are also typically provided in the upper surface 33 of the intermediate section 31 adjacent to oppositely-disposed segments of the raised lip 17, to further stiffen the food, beverage and utility tray 11. In yet another preferred embodiment of the invention both the cup holder 21 and the hand grip 35 are frusto-conical in shape to facilitate stacking and nesting of multiple units of the food, beverage and utility tray 11 in storage configuration (not illustrated).

Figure 1A:
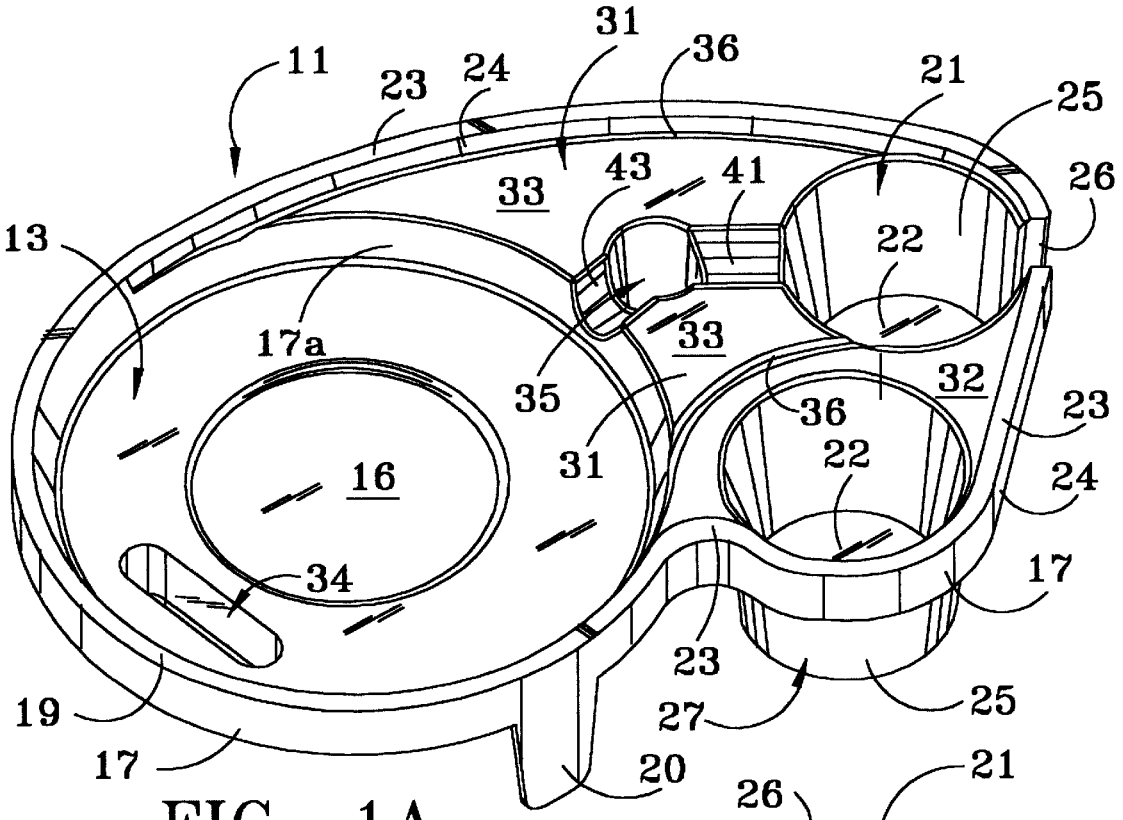
FIG. 1A is a perspective view of a second preferred embodiment of the food, beverage and utility tray illustrated in FIGS. 1 and 2, including a supplemental, non-slotted glass or cup holder provided in the intermediate section of the tray.
Figure 2A:
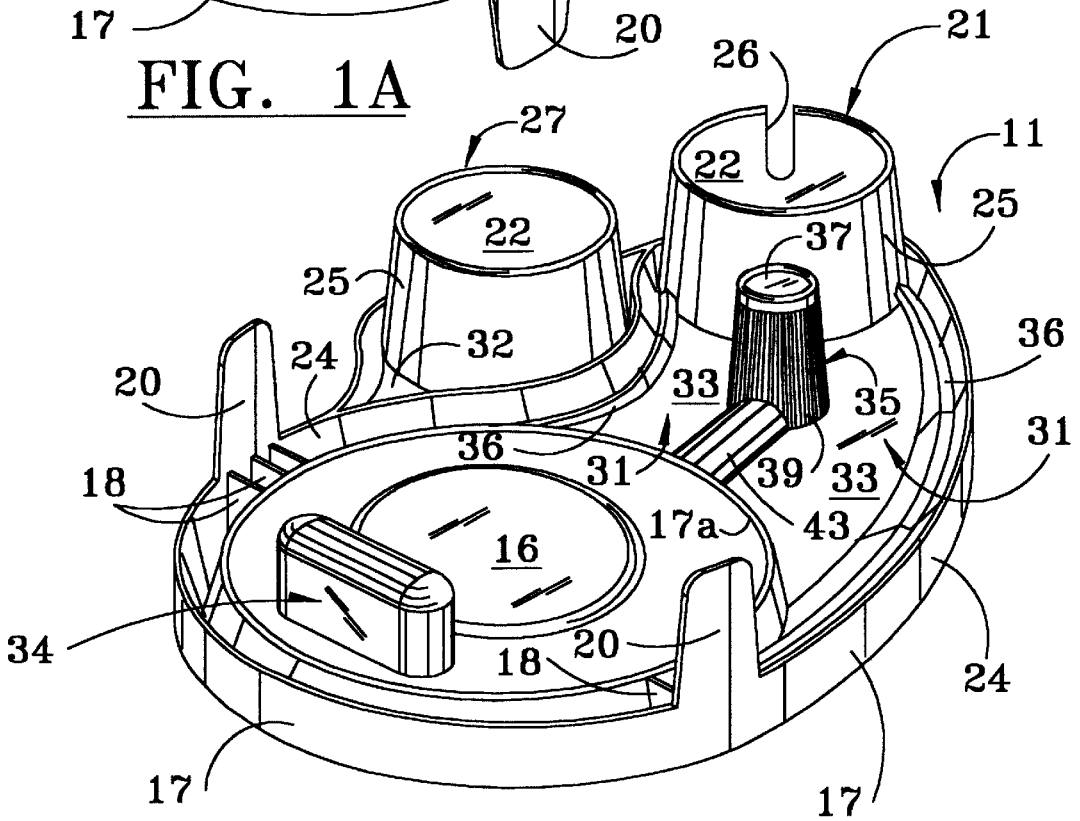
FIG. 2A is an inverted perspective view of the food, beverage and utility tray illustrated in FIG. 1A.

Referring now to FIGS. 1A and 2A of the drawings in another preferred embodiment of the invention the food, beverage and utility tray 11 includes a supplemental cup holder 27, which is preferably shaped integrally with the concave portion of the intermediate section 31, to define an intermediate upper surface 32, coplanar with the upper surface 33, and a downwardly-extending, typically frusto-conical, continuous side 25, terminating in a flat cup holder bottom 22. The flat bottom 22 is preferably coplanar with the cup holder bottom 22 of the cup holder 21, the hand grip bottom 37 of the had grip 35 and the bottom edges of the lip supports 20. A stiffener 36 extends between the lip extension 17*a* bordering the inner plate section 15 on one side in the upper surface 33, to the cup holder 21 to further stiffen the upper surface 33, as heretofore described. Accordingly, considering the configuration of the food, beverage and utility tray 11 illustrated in FIGS. 1A and 2A, a user may place a drink container including a wine glass, goblet or "stem" in the stem glass slot 26 of the cup holder 21 and another glass or cup in the supplemental cup holder 27, along with a single plate in the plate section 13, resting on the inner plate section 15, while grasping the serrations 39 of the hand grip 35 and allowing the projecting arm rest 34 to rest on the forearm of the same hand, leaving the other hand free. While a stem glass slot 26 is not illustrated in the supplemental cup holder 27, it will be appreciated that such a slot can be included, as desired.

Figure 3:
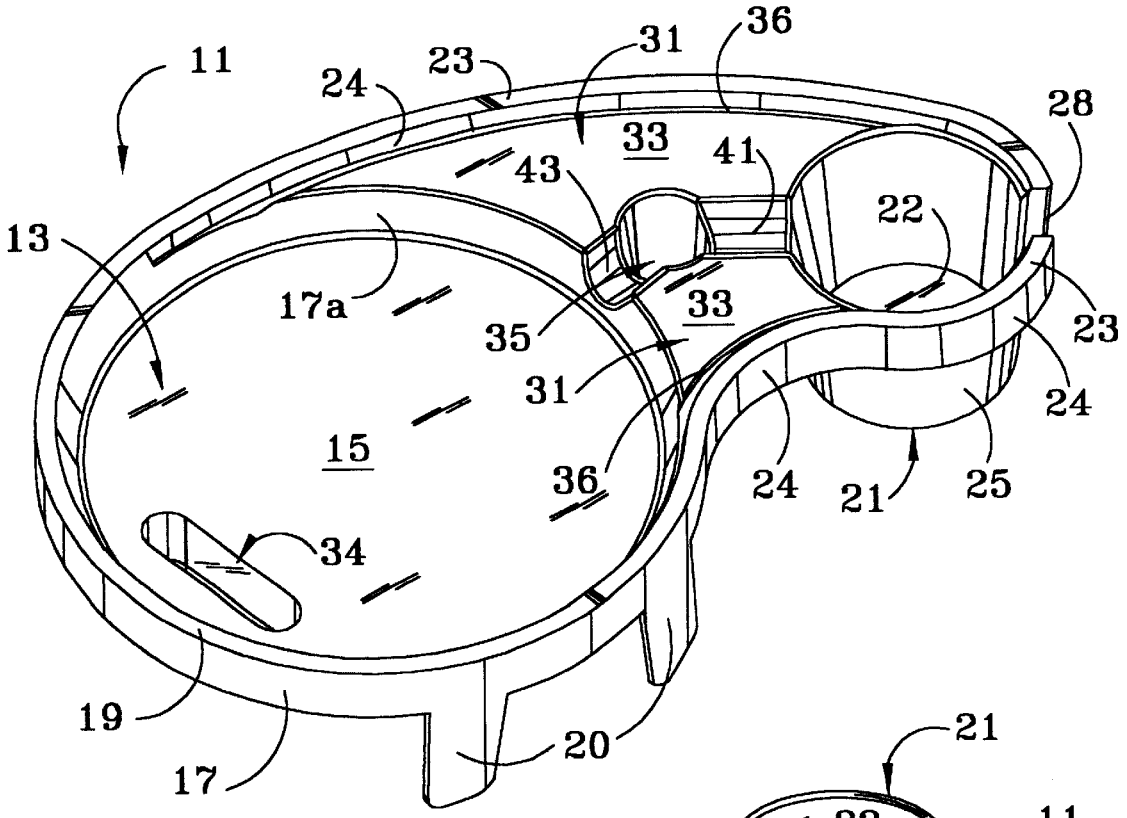
FIG. 3 is a perspective view of an alternative preferred embodiment of the food, beverage and utility tray illustrated in FIGS. 1 and 2, more particularly illustrating four substantially flat, spaced-apart legs downwardly-extending from the plate section of the tray.
Figure 4:
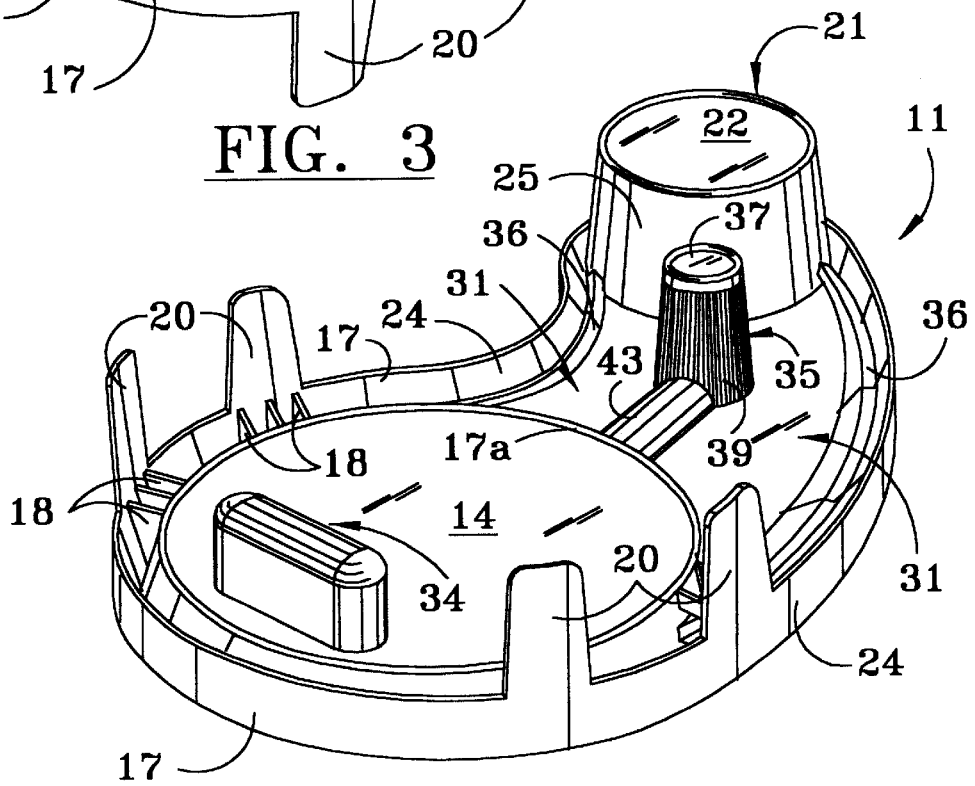
FIG. 4 is an inverted perspective view of the food, beverage and utility tray illustrated in FIG. 3.

Referring now to FIGS. 3 and 4 of the drawings, in still another embodiment of the food, beverage and utility tray 11 of this invention an extra pair of lip supports 20 extend downwardly and slightly outwardly from the raised lips 17 in spaced-apart relationship with respect to each other, to further stabilize the food, beverage and utility tray 11 on a flat surface. As in the case of the food, beverage and utility tray 11 illustrated in FIGS. 1 and 2, this embodiment of the tray includes the primary embodiments described therein, including a downwardly-extending arm rest 34, a cup holder 21 and a hand grip 35. It will be appreciated by those skilled in the art that the food, beverage and utility tray 11 illustrated in FIGS. 3 and 4 might also incorporate the stem glass slot 26 and/or the supplemental cup holder 27, as illustrated in FIGS. 1A and 2A, as heretofore described with respect to that embodiment of the invention. A finger access slot 28 is provided in place of the stem glass slot 26, as illustrated.

Figure 5:
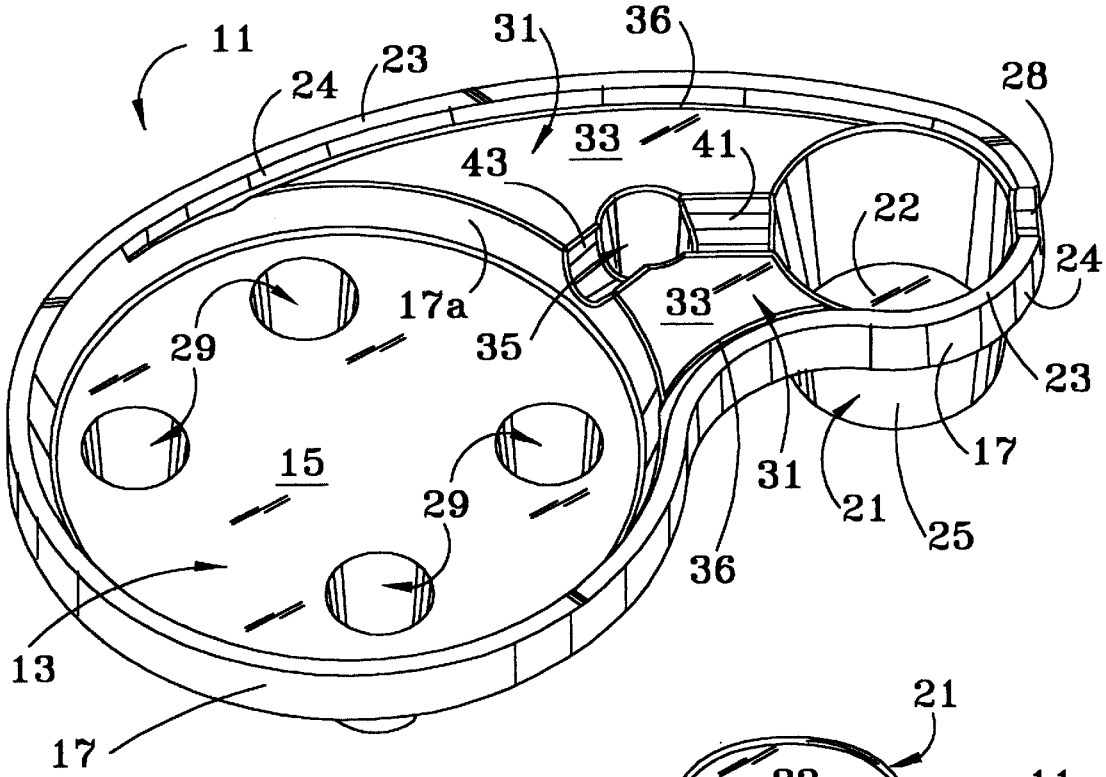
FIG. 5 is a perspective view of another embodiment of the food, beverage and utility tray illustrated in FIGS. 1 and 2, more particularly illustrating four, downwardly-extending, spaced-apart, frusto-conical shaped interior supports or legs projecting downwardly from the plate section of the try
Figure 6:
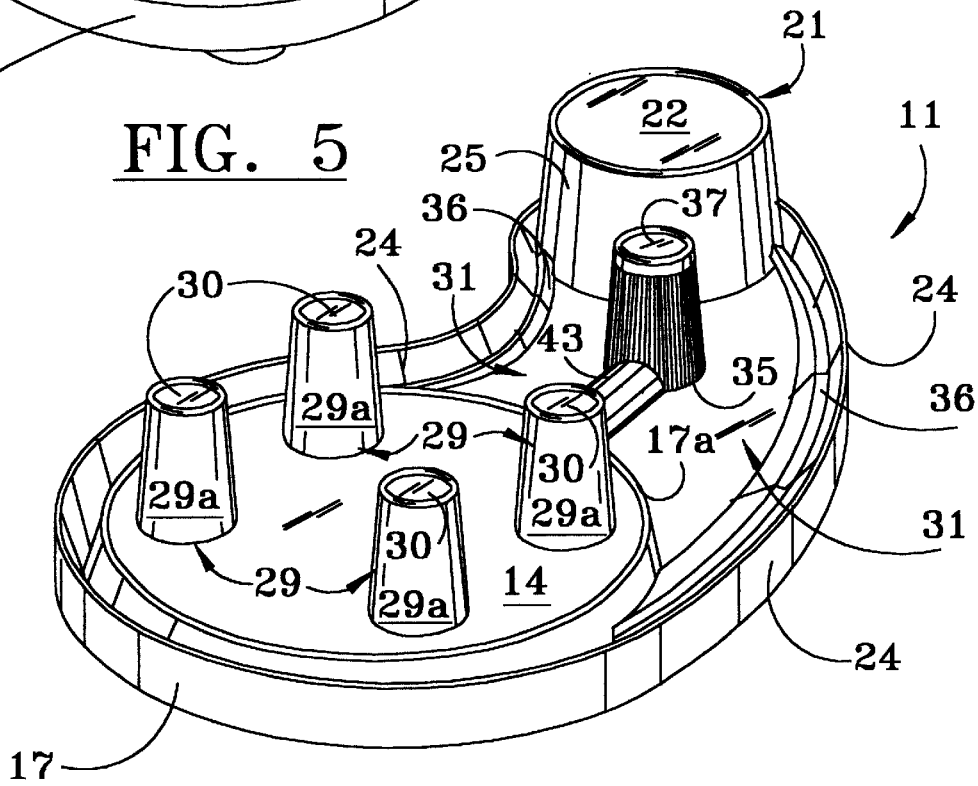
FIG. 6 is an inverted perspective view of the food, beverage and utility tray illustrated in FIG. 5.

Referring to FIGS. 5 and 6 of the drawings, in yet another preferred embodiment of the invention the food, beverage and utility tray 11 is characterized by the basic design illustrated in FIGS. 1 and 2, with the omission of the lip supports 20, the arm rest 34 and the stem glass slot 26, and the addition of four interior supports 29, having continuous, frusto-conically shaped support sides 29*a*, which terminate at an interior support bottom 30. Accordingly, the interior supports 29, like the cup holder 21, the supplemental cup holder 27 (FIGS. 1A and 2A) and the hand grip 35, are frusto-conical in configuration to facilitate nesting and stacking of multiple units of the food, beverage and utility tray 11 to conserve storage space. The respective interior support bottoms 30 are typically coplanar with the hand grip bottom 37 and the cup holder bottom 22 for resting stability and may incorporate the stem glass slot 26, and/or the arm rest 34 illustrated in FIGS. 1, 2, 1A and 2A, as well as the supplemental cup holder 27, illustrated in FIGS. 1A and 2A, as desired.

Figure 7:
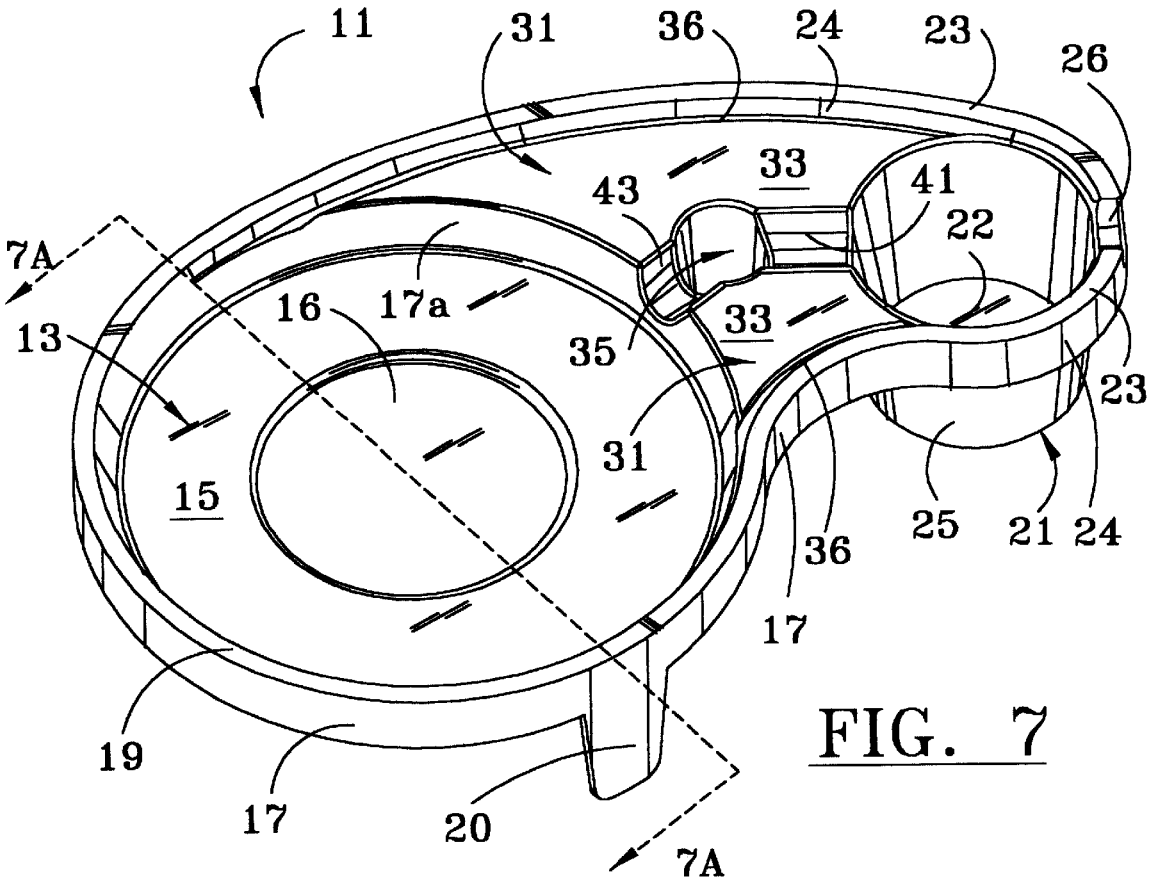
Figure 7A:
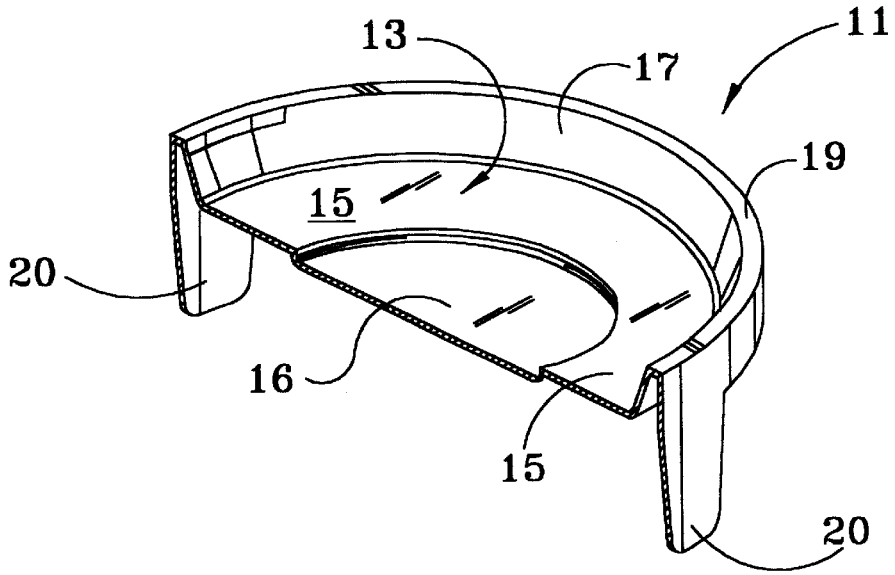
FIG. 7A is a sectional view, taken along line 7A—7A, of the plate section of the food beverage and utility tray illustrated in FIG. 7, more particularly illustrating a pair of downwardly-extending, oppositely-disposed, substantially flat legs or supports.

Referring to FIGS. 7 and 7A of the drawings, in a further preferred embodiment of the invention the food, beverage and utility tray 11 is characterized by the embodiments illustrated in FIGS. 1 and 2, less the arm rest 34 and stem glass slot 26 and further includes a plate section 13 having a plate indentation or recess 16 for accommodating a saucer, a salad plate or dessert plate of smaller diameter than the average size dinner plate which may be placed on the inner plate section 15 of the plate section 13. Accordingly, the food, beverage and utility tray 11 illustrated in the embodiment of FIGS. 7 and 7A may easily accommodate plates, saucers and other containers of various diameter and configuration by use of the plate indentation 16. It will be appreciated by those skilled in the art that the embodiment of the food, beverage and utility tray 11 illustrated in FIGS. 7 and 7A may also embody the features of the previously discussed embodiments, including, but not limited to the supplemental cup holder 27, the arm rest 34, four spaced-apart lip supports 20 rather than the two lip supports 20 illustrated in FIGS. 7 and 7A and the alternative frusto-conical interior supports 29 illustrated in FIGS. 5 and 6, in place of the lip supports 20.

The food, beverage and utility tray 11 of this invention, in its various embodiments, is very easy to use. The hand grip 35 is first securely grasped by one hand at the serrations 39 and the plate section 13 is extended over the forearm, such that those embodiments of the food, beverage and utility tray 11 which have the arm rest 34 (FIGS. 1, 2, 1 A, 2A, 3 and 4), rest on the forearm at the arm rest 34. In those embodiments of the food, beverage and utility tray 11 which do not have the arm rest 34 (FIGS. 5, 6, 7 and 7A), the plate section bottom 14 of the plate section 13 rests on the forearm instead. A food plate of various size, including a saucer, salad plate or dessert plate corresponding to the plate indentation 16 in the embodiment illustrated in FIGS. 7 and 7A, can be placed in the plate section 13 resting on the inner plate section 15 or the plate indentation 16, depending upon the size of the plate. One or more beverage containers (not illustrated) can then be placed in the cup holder 21 and, in the case of the embodiment illustrated in FIGS. 1A and 2A, also in the supplemental cup holder 27, and utensils such as knives, forks, spoons and the like along with a napkin (not illustrated) can be inserted in the hollow hand grip 35, for convenience. Accordingly, one hand of the user is free to eat and drink by accessing the plate and the glass or glasses in the food, beverage and utility tray 11, without the necessity of balancing the plate and glasses and eat at the same time. When not in use, the food, beverage and utility tray 11 can be nested and stacked in a relatively small space for future use.

The food, beverage and utility tray 11 of this invention, in its various embodiments has several advantages over the prior art. The tray is lightweight and easy to hold, handle, manipulate and balance with one hand. However, the tray is also strong and capable of holding a full plate of food, and one or two beverage containers, without spilling. Considerable space is also saved during storage, since respective food, beverage and utility trays 11 can be stacked and nested, as described. The tray can be typically vacuum formed or injection-molded, in non-exclusive particular, from plastic materials according to the manufacturer's standards.

It will be appreciated by those skilled in the art from a consideration of the various embodiments of the invention that the nesting and storage of the various configurations of the food, beverage and utility tray 11 are possible only under circumstances where the various food, beverage and utility tray 11 are of the same design. For example, the designs in the embodiments illustrated in FIGS. 1, 2, 3 and 4 will readily stack and nest for compact storage because of the common features of nesting single cup holders 21 and common overlapping lip supports 20 and nesting arm rests 34. Although an extra set of lip supports 20 is illustrated in the embodiment illustrated in FIGS. 3 and 4, this provision does not prevent the stacking of these trays with the tray embodiments illustrated in FIGS. 1 and 2, as the lip supports 20 extend outwardly in overlapping relationship. Similarly, the embodiments illustrated in FIGS. 1A and 2A may be stacked together, but not with the designs illustrated in the other embodiments of the invention, because of the supplemental cup holder 27. In like manner, the embodiments illustrated in FIGS. 5 and 6 and FIGS. 7 and 7A, respectively, may only be stacked because of the particular design of the interior supports 29 and the plate indentations 16.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A food, beverage and utility tray comprising:

a plate section having a planar inner section surrounded by a raised lip and a lip extension continuous with said raised lip;

at least two supports extending from said plate section in spaced-apart relationship with respect to each other for supporting said plate section on a supporting surface;

at least one cup holder for holding a beverage container;

an intermediate section connecting said plate section to said cup holder;

a hand grip extending downwardly from said intermediate section for positioning said tray in functional configuration on one arm of a user; and an arm rest provided in said planar inner section for resting said tray on said one arm.

2. The food, beverage and utility tray of claim 1 wherein said hand grip is hollow and has an open upper end and a closed lower end, for containing tableware and condiments.

3. The food, beverage and utility tray of claim 1 wherein said hand grip is hollow and has an open upper end and a closed lower end for containing tableware and condiments, and wherein said cup holder and said hand grip are tapered downwardly in a substantially frusto-conical configuration, wherein said tray can be nested with other food and beverage trays of the same design.

4. The food, beverage and utility tray of claim 1 comprising an intermediate lip continuous with said raised lip and extending around said intermediate section and wherein said raised lip is tapered downwardly for nesting.

5. The food, beverage and utility tray of claim 4 wherein said planar inner section comprises a plate indentation, said hand grip has exterior serrations for gripping said hand grip and said intermediate lip extends around an outer aspect of said cup holder; and comprising a first finger indentation in said lip extension for accessing a plate on said planar inner section and a second finger indentation provided in said intermediate section and a third finger indentation provided in that portion of said intermediate lip that extends around the outer aspect of said cup holder, diametrically opposite to said second finger indentation for accessing a beverage container in said cup holder.

6. The food, beverage and utility tray of claim 1 wherein said at least one cup holder comprises a first cup holder and a supplemental cup holder.

7. The food, beverage and utility tray of claim 6 wherein said hand grip is hollow and has an open upper end and a closed lower end, for containing tableware and condiments, and wherein said first cup holder, said supplemental cup holder and said hand grip are tapered downwardly in a substantially frusto-conical configuration, wherein said tray can be nested with other food and beverage trays of the same design.

8. The food, beverage and utility tray of claim 7 wherein said raised lip is tapered downwardly for nesting.

9. The food, beverage and utility tray of claim 8 wherein said planar inner section comprises a plate indentation and an intermediate lip continuous with said raised lip and extending around said intermediate section and said hand grip has exterior serrations for gripping said hand grip and said intermediate lip extends around an outer aspect of said first cup holder and said supplemental cup holder, respectively; and comprising a first finger indentation in said lip extension for accessing a plate on said planar inner section and a second finger indentation provided in said intermediate section and a third finger indentation provided in that portion of said intermediate lip that extends around the outer aspect of said first cup holder, diametrically opposite to said second finger indentation for accessing a beverage container in said first cup holder.

10. The food, beverage and utility tray of claim 9 comprising a slot provided in at least one of said first cup holder and said supplemental cup holder for accessing a stem.

11. The food, beverage and utility tray of claim 1 wherein said at least two supports comprise at least two substantially flat supports extending downwardly from said plate section for supporting said plate section when said tray is placed on the supporting surface.

12. The food, beverage and utility tray of claim 11 wherein said hand grip is hollow and has an open upper end and a closed lower end for containing tableware and condiments, and wherein said cup holder and said hand grip are tapered downwardly in a substantially frusto-conical configuration, wherein said tray can be nested with other food, beverage and utility trays of the same design.

13. The food, beverage and utility tray of claim 12 wherein said flat supports and said raised lip are tapered downwardly wherein said tray can be nested.

14. The food, beverage and utility tray of claim 13 wherein said at least one cup holder comprises a first cup holder and a supplemental cup holder.

15. The food, beverage and utility tray of claim 14 comprising a slot provided in at least one of said first cup holder and said supplemental cup holder for accessing a stem.

16. The food, beverage and utility tray of claim 1 wherein said at least two supports comprises at least two frusto-conical supports extending downwardly from said plate section for providing additional support to said plate section when said tray is placed on the supporting surface; said cup holder and said hand grip are frusto-conical in shape for nesting of multiple ones of said food and beverage tray and said supports extend downwardly on opposite sides of said one arm when said tray is held.

17. The food, beverage and utility tray of claim 16 wherein said hand grip is hollow and has an open upper end and a closed lower end for containing tableware and condiments.

18. The food, beverage and utility tray of claim 17 comprising an intermediate lip continuous with said raised lip and extending around said intermediate section and an outer aspect of said cup holder; and wherein said raised lip is tapered downwardly for nesting and comprising a first finger indentation provided in said lip extension for accessing a plate on said planar inner section and a second finger indentation provided in said intermediate section and a third finger indentation provided in that portion of said intermediate lip that extends around the outer aspect of said cup holder, diametrically opposite to said second finger indentation for accessing a beverage container in said cup holder.

19. The food, beverage and utility tray of claim 18 wherein said cup holder comprises a first cup holder and a supplemental cup holder and said third finger indentation is provided in that portion of said intermediate lip that extends around the outer aspect of said first cup holder.

20. The food, beverage and utility tray of claim 19 wherein said at least one planar inner section comprises a plate indentation and said hand grip has exterior serrations for gripping said hand grip.

21. A food, beverage and utility tray comprising:

a plate section for supporting a plate and a planar inner section having a plate indentation provided in said plate section for accommodating plates of different size, said plate indentation substantially concentric with said plate section and said planar inner section surrounded by a raised tapered lip and a lip extension continuous with said raised tapered lip;

at least one cup holder for holding at least one beverage container;

an intermediate section connecting the plate section to said cup holder and an intermediate lip continuous with said raised lip, said intermediate lip extending around said intermediate section;

at least two legs or supports extending from said plate section in spaced-apart relationship with respect to each other for supporting said plate section on a supporting surface; and a hand grip extending downwardly from said intermediate section.

22. The food, beverage and and utility tray of claim 21, wherein said at least one cup holder comprises a cup holder and a supplemental cup holder.

23. The food, beverage and utility tray of claim 22 wherein said intermediate lip extends around an outer aspect of said first cup holder and said supplemental cup holder, respectively; and comprising a first finger indentation in said lip extension for accessing a plate on said planar inner section; a second finger indentation provided in said intermediate section; and a third finger indentation provided in that portion of said intermediate lip that extends around said first cup holder for accessing the beverage container in said first cup holder.

24. The food, beverage and utility tray of claim 23 comprising an arm rest provided in said plate section for supporting said tray on one arm and wherein said cup holder, said supplemental cup holder, said supports and said hand grip are substantially coplanar at the extending ends thereof, for supporting said food, beverage and utility tray on a supporting surface.

* * * * *